United States Patent [19]

Alig

[11] Patent Number: 4,634,923

[45] Date of Patent: Jan. 6, 1987

[54] COLOR PICTURE TUBE HAVING IMPROVED ELECTRON GUN

[75] Inventor: Roger C. Alig, Princeton Junction, N.J.

[73] Assignee: RCA Corporation, Princeton, N.J.

[21] Appl. No.: 94,557

[22] Filed: Nov. 15, 1979

[51] Int. Cl.[4] ..... B65B 21/02

[52] U.S. Cl. ..... 313/413; 313/409; 313/412

[58] Field of Search ..... 313/412, 414, 413, 409

[56] References Cited

U.S. PATENT DOCUMENTS

| | | | |
|---|---|---|---|
| Re. 29,740 | 8/1978 | Yoshida et al. | 315/368 |
| Re. 29,895 | 1/1979 | Murata et al. | 313/412 |
| 3,164,737 | 1/1965 | Messineo et al. | 313/473 |
| 3,196,304 | 7/1965 | Barkow | 313/473 |
| 3,534,208 | 10/1970 | Krackhardt et al. | 313/412 |
| 3,548,249 | 12/1970 | Yoshida et al. | 315/13 |
| 3,553,523 | 1/1971 | Budd | 315/13 |
| 3,594,600 | 7/1971 | Murata et al. | 313/412 |
| 3,772,554 | 11/1973 | Hughes | 313/414 |
| 3,860,850 | 1/1975 | Takenaka et al. | 313/428 |
| 3,873,879 | 3/1975 | Hughes | 313/412 |
| 4,057,747 | 11/1977 | Hamano | 313/414 |
| 4,086,513 | 4/1978 | Evans, Jr. | 313/414 |
| 4,142,131 | 2/1979 | Ando et al. | 313/412 |
| 4,225,804 | 9/1980 | Bekaert et al. | 313/413 |

FOREIGN PATENT DOCUMENTS 52-116020 3/1976 Japan .

*Primary Examiner*—David K. Moore

*Attorney, Agent, or Firm*—Eugene M. Whitacre; Dennis H. Irlbeck; Vincent J. Coughlin, Jr.

[57] ABSTRACT

An improved color picture tube has an inline electron gun for generating and directing three electron beams, comprising a center beam and two outer beams, along coplanar paths toward a screen of the tube. The three beams pass through a deflection zone adapted to have vertical and horizontal magnetic deflection fields established therein. The improvement comprises the inclusion of means for nonlinearly increasing the effect of the vertical magnetic deflection field on the center beam relative to the outer beams with increasing angles of vertical deflection of the beams.

6 Claims, 6 Drawing Figures

COLOR PICTURE TUBE HAVING IMPROVED ELECTRON GUN

BACKGROUND OF THE INVENTION

The present invention relates to a color picture tube having an improved inline gun, and particularly to an improvement in the electron gun for providing a nonlinear correction in raster sizes (also called nonlinear coma correction) within the tube.

An inline electron gun is one designed to generate preferably three electron beams in a common plane and direct those beams along convergent paths in that plane to a point or small area of convergence near the tube screen.

A problem that exists in a color picture tube having an inline gun is a coma distortion wherein the sizes of the three rasters scanned by the three beams on the screen by an external magnetic deflection yoke are different because of the eccentricity of the two outer beams with respect to the center of the yoke.

Messineo et al. U.S. Pat. No. 3,164,737, issued Jan. 5, 1965, teaches that a similar coma distortion caused by using different beam velocities can be corrected by use of a magnetic shield around the path of one or more beams in a three gun assembly. Barkow U.S. Pat. No. 3,196,305, issued July 20, 1965, teaches the use of magnetic enhancers adjacent to the path of one or more beams in a delta gun, for the same purpose. Krackhardt et al. U.S. Pat. No. 3,534,208, issued Oct. 13, 1970, teaches the use of a magnetic shield around the middle one of three inline beams for coma correction. Yoshida et al. U.S. Pat. No. 3,548,249, issued Dec. 15, 1970, teaches the use of C-shaped elements positioned between the center and outer beams to enhance the effect of the vertical deflection field on the center beam. Murata et al. U.S. Pat. No. 3,594,600, issued July 20, 1971, teaches the use of C-shaped shields around the outer beams with the open sides of the members facing each other. These shields appear to shunt the vertical deflection field around all three beams. Takenaka et al. U.S. Pat. No. 3,860,850, issued Jan. 14, 1975, teaches the use of V-shaped enhancement members located above and below three inline beams and the use of C-shaped shields around the two outer beams. Hughes U.S. Pat. No. 3,873,879, issued Mar. 25, 1975, teaches the use of small disc-shaped enhancement elements above and below the center beam and ring shaped shunts around the two outer beams.

It has been found that for some tubes, the coma height grows nonlinearly with beam deflection on the screen. All of the foregoing coma correction devices only correct for linearly growing coma. Therefore, there is a need for coma correction members that will provide a nonlinear correction for nonlinearly growing coma.

SUMMARY OF THE INVENTION

An improved color picture tube has an inline electron gun for generating and directing three electron beams, comprising a center beam and two outer beams, along coplanar paths toward a screen of the tube. The three beams pass through a deflection zone adapted to have vertical and horizontal magnetic deflection fields established therein. The improvement comprises the inclusion of means for nonlinearly increasing the effect of the vertical magnetic deflection field on the center beam relative to the outer beams with increasing angles of vertical deflection of the beams.

DETAILED DESCRIPTION OF THE PREFERRED EMBODIMENT

Figure 1:
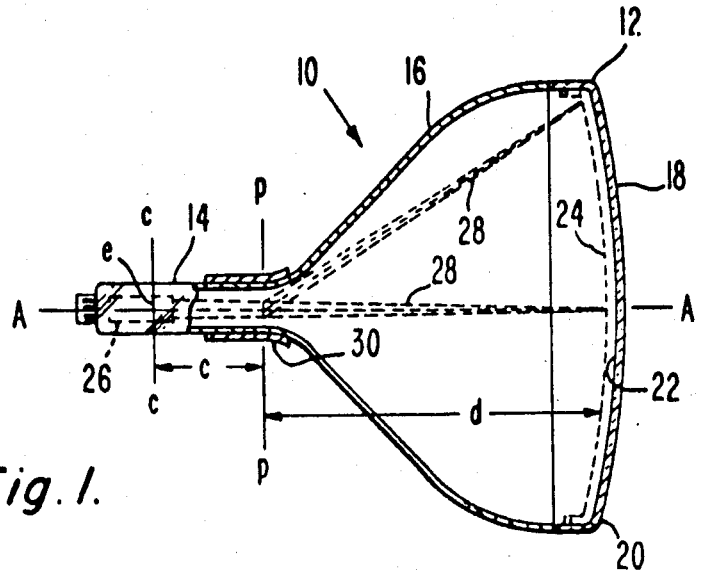
FIG. 1 is a plan view, partly in axial section of a shadow mask color picture tube in which one embodiment of the present invention is incorporated.

FIG. 1 is a plan view of a rectangular color picture tube 10 having a glass envelope 11 comprising a rectangular faceplate panel or cap 12 and a tubular neck 14 connected by a rectangular funnel 16. The panel comprises a viewing faceplate 18 and a peripheral flange or sidewall 20 which is sealed to the funnel 16. A mosaic three-color phosphor screen 22 is carried by the inner surface of the faceplate 18. The screen is preferably a line screen with the phosphor lines extending substantially parallel to the minor axis Y—Y of the tube (normal to the plane of FIG. 1). A multi-apertured color selection electrode or shadow mask 24 is removably mounted, by conventional means, in predetermined spaced relation to the screen 22. An improved inline electron gun 26, shown schematically by dotted lines in FIG. 1, is centrally mounted within the neck 14 to generate and direct three electron beams 28 along coplanar convergent paths through the mask 24 to the screen 22.

The tube 10 of FIG. 1 is designed to be used with an external magnetic deflection yoke, such as the yoke 30 schematically shown surrounding the neck 14 and funnel 16 in the neighborhood of their junction, for subjecting the three beams 28 to vertical and horizontal magnetic flux, to scan the beams horizontally and vertically, respectively, in a rectangular raster over the screen 22. The initial plane of deflection (at zero deflection) is shown by the line P—P in FIG. 1 at about the middle of the yoke 30. Because of fringe fields, the zone of deflection of the tube extends axially, from the yoke 30 into the region of gun 26. For simplicity, the actual curvature of the deflected beam paths in the deflection zone is not shown in FIG. 1.

Figure 2:
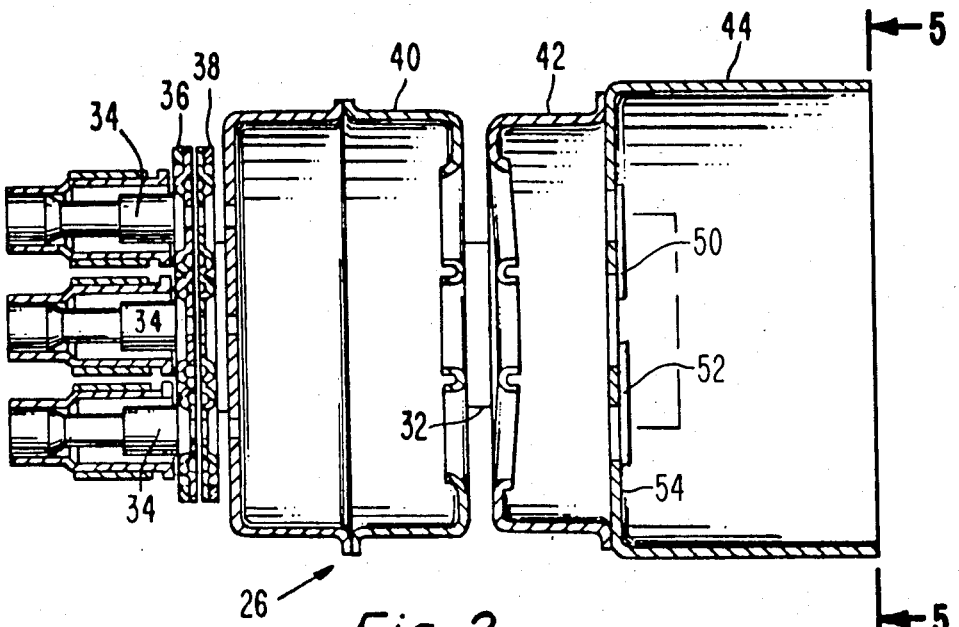
FIG. 2 is an axial section view of the electron gun shown in dashed lines in FIG. 1.

The details of the gun 26 are shown in FIG. 2. The gun comprises two glass support rods 32 on which the various electrodes are mounted. These electrodes include three equally spaced coplanar cathodes 34 (one for each beam), a control grid electrode 36, a screen grid electrode 38, a first accelerating and focusing electrode 40, a second accelerating and focusing electrode 42, and a nonmagnetically permeable electrical shield cup 44, spaced along the glass rods 32 in the order named. Four magnetically permeable coma correction members 46, 48, 50, and 52 are located on the back wall 54 of the shield cup 44. Only the lower two members 50 and 52 are shown in FIG. 2 since the upper two members 46 and 48 have been cut-away. Fringe lines of magnetic flux from the yoke 30 extend to behind the shield cup 44 thereby causing some electron beam deflection slightly before the beams pass the coma correction members. The shape, size, position and function of these members 46, 48, 50 and 52 will be hereinafter discussed in greater detail.

Further detail of an electron gun similar to gun 26 of FIG. 2 is contained in U.S. Pat. No. 3,772,554, issued to R. H. Hughes on Nov. 13, 1973. This patent is hereby incorporated by reference for the purpose of including such detail.

Figure 3:
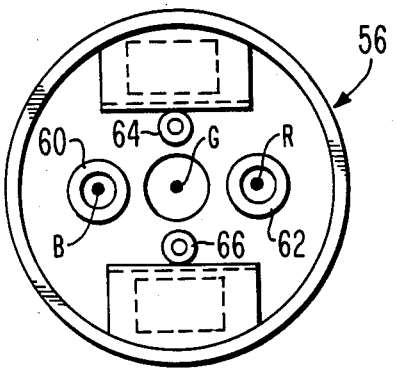
PRIOR ART Fig. 3.
FIG. 3 is a plan view of the output end of a prior art electron gun wherein the gun includes coma correcting shunts and enhancers.
Figure 4:
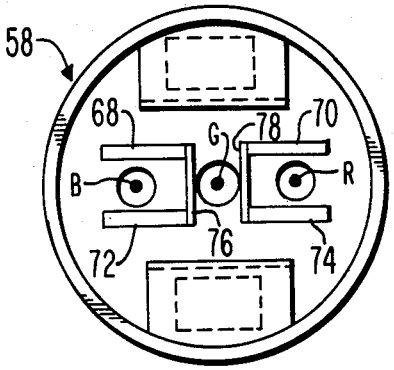
PRIOR ART Fig. 4.
FIG. 4 is a plan view of the output end of a prior art electron gun wherein the gun includes C-shaped coma correcting members.

FIGS. 3 and 4 show the shield cups of two prior art electron guns 56 and 58 and their associated coma correction members. In the first gun 56 of FIG. 3, which is described in aforementioned U.S. Pat. No. 3,873,879, two small washer-shaped elements 60 and 62 shunt the two outer beams B and R and two disc shaped enhancers 64 and 66 are located above and below the center beam G. The shunts 60 and 62 and the enhancers 64 and 66 distort portions of the two deflection fields to provide enhanced vertical and horizontal deflection of the center beam and decreased vertical and horizontal deflection of the two outer beams.

In the second gun 58 of FIG. 4, which is described in U.S. Pat. No. 4,142,131, issued to Ando et al. on Feb. 27, 1979, magnetic pole piece plates 68, 70, 72 and 74 are located above and below the outer beams B and R and two other parallel plates 76 and 78 are located between the outer beams B and R and the center beam G. The predominant net result is an increase of the vertical magnetic deflection field acting on the center beam and a decrease of the same field acting on the outer beams.

Figure 5:
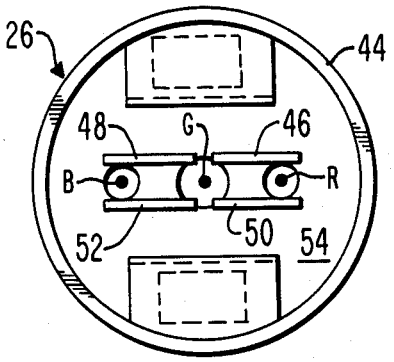
FIG. 5 is a plan view of the electron gun of FIG. 2 taken at line 5—5 illustrating one embodiment of the present invention.
Figure 6:
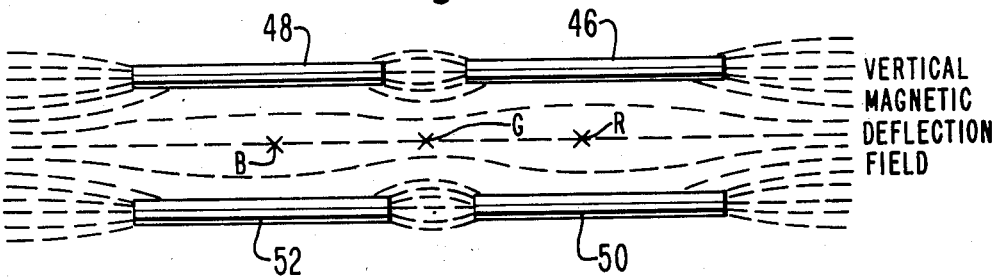
FIG. 6 illustrates the nonlinear effect that the novel coma correcting elements of the novel electron gun of FIGS. 2 and 5 have on the vertical magnetic deflection field.

A front view of the gun 26 having novel coma correction member 46, 48, 50 and 52 is shown in FIG. 5. These members 46, 48, 50 and 52 are constructed of a high magnetic permeability material such as the alloy of 52-percent nickel and 48-percent iron known as "52 metal". The members 46, 48, 50 and 52 are straight bar or rail-shaped elements that are substantially longer than they are wide. Hereinafter, these members will be referred to as rails. The rails 46, 48, 50 and 52 are positioned in parallel pairs above and below each outer beam with the longer dimensions of the rails extending horizontally. The rail pair 46 and 50 bracket the outer beam R, and the rail pair 48 and 52 bracket the other outer beam B. The two upper rails 46 and 48 are axially aligned with each other, and the two lower rails 50 and 52 are also axially aligned with each other. The horizontal spacing between the two upper rails 46 and 48 and between the two lower rails 50 and 52 is substantially close enough to cause the horizontally extending lines of magnetic flux to sufficiently bow between them to affect the concentration of magnetic flux lines at the center beam. In the particular embodiment shown, the horizontal spacing between rails is less than the diameter of the center aperture of the shield cup 44. This bowing effect can be seen in the illustration of FIG. 6. At the outside ends of the rails 46, 48, 50 and 52, the horizontally extending lines of magnetic flux that form a portion of the vertical magnetic deflection field are attracted, thereby shunting some of the field from the two outer beams B and R. Although the rails are shown ending slightly outside the two outer beam apertures, in other embodiments they may even extend to the sides of the shield cup 44. Near the center beam G, however, the flux lines bow outwardly in the gap between the rails. The effect of this bowing on the magnetic flux lines near the center beam is to somewhat compress them toward their undisturbed state. Because of this action caused by the rails, the effect of the vertical magnetic deflection field on the outer beams is decreased and the relative effect on the center beam is enhanced. However, as the three beams are increasingly deflected vertically, the center beam passes through an increasingly greater number of magnetic flux lines, thereby nonlinearly increasing the effect of the vertical magnetic deflection field on the center beam. As the outer beams are increasingly deflected vertically, however, the outer beams pass through a decreasingly lesser number of magnetic flux lines, thereby nonlinearly decreasing the effect of the vertical magnetic deflection field on the outer beams. The net result, then, is that the center beam raster is nonlinearly increased relative to the outer beam rasters with increasing angles of vertical magnetic deflection of the beams.

The rails 46, 48, 50 and 52 have relatively little effect on the horizontal magnetic deflection field. Such effect is to slightly increase the effect of the horizontal magnetic deflection field on the outer beams and to slightly decrease the effect of the horizontal magnetic deflection field on the center beam. The effects occur because the rails attract a greater concentration of magnetic flux lines thereby reducing those passing near the center beam but increasing the lines passing near the outer beams.

Typical dimensions for a 67 cm diagonal, 110° deflection type tube incorporating the gun of FIGS. 2 and 5 are as follows.

Spacing between center and outer beam paths: 6.60 mm

Length of members 46, 48, 50 and 52 (Measured horizontally): 7.62 mm

Width of members 46, 48, 50 and 52 (Measured vertically): 1.02 mm

Thickness of members 46, 48, 50 and 52 (Measured along the gun axis): 0.25 mm

Vertical spacing between members, 46 to 50 and 48 to 52: 4.06 mm

Horizontal spacing between members, 46 to 48 and 50 to 52: 2.54 mm

Ratio of horizontal spacing between rails to horizontal spacing between outer beams: 0.19

Ratio of vertical spacing between rails to horizontal spacing between an outer beam and the center beam: 0.61

Although the present invention has been described with respect to a tube having a unitized type inline gun with small spacings between beam paths, it should be understood that the invention is also applicable to other tubes having different types of inline electron guns, such as those having larger beam path spacings and/or nonunitized construction, and to those having different types of focusing, e.g., unipotential, tripotential, or double bipotential focusing systems.

What is claimed is:

1. In a color picture tube having an inline electron gun for generating and directing three electron beams, comprising a center beam and two outer beams, along coplanar paths toward a screen of said tube, said electron gun including a shield cup having a base with three apertures therein corresponding to the electron beam paths, wherein the beams pass through a deflection zone adapted to have vertical and horizontal magnetic deflection fields established therein, the improvement comprising four magnetically permeable horizontally extending rails located on said base of said shield cup, said rails being positioned in parallel pairs above and below each of said outer beams in a fringe of the deflection zone, the horizontal spacing between the two upper rails and between the two lower rails being less than the diameter of the center aperture of said shield cup, thereby causing the horizontally extending lines of magnetic flux that form a portion of the vertical magnetic deflection field to sufficiently bow outwardly in the gap between the two upper rails and between the two lower rails to compress the magnetic flux lines near the center beam thus nonlinearly increasing the effect of the vertical magnetic deflection field on the center beam relative to the outer beams with increasing angles of vertical deflection of the beams.

2. In a color picture tube having an inline electron gun for generating and directing three electron beams, comprising a center beam and two outer beams, along coplanar paths toward a screen of said tube, said electron gun including a shield cup, having a base with three apertures therein corresponding to the electron beam paths, wherein the beams pass through a deflection zone adapted to have vertical and horizontal magnetic deflection fields established therein, the improvement comprising four magnetically permeable horizontally extending rails located on said base of said shield cup, said rails being positioned in parallel pairs above and below each of said outer beams in a fringe of the deflection zone, the horizontal spacing between the two upper rails and between the two lower rails being less than the diameter of the center aperture of said shield cup, thereby causing the horizontally extending lines of magnetic flux that form a portion of the vertical magnetic deflection field to sufficiently bow between the two upper rails and between the two lower rails to affect the concentration of magnetic flux lines at the center beam to nonlinearly increase the effect of the vertical magnetic deflection field on the center beam relative to the outer beams with increasing angles of vertical deflection of the beams.

3. The tube as defined in claim 2 wherein the horizontal distance between rails is approximately 0.19 times the horizontal spacing between the two outer beams.

4. The tube as defined in claim 3 wherein the horizontal distance between rails is approximately 2.54 mm and the horizontal spacing between the two outer beams is approximately 13.2 mm.

5. The tube as defined in claim 2 wherein the vertical spacing between rails is approximately 0.61 times the horizontal spacing between an outer beam and the center beam.

6. The tube as defined in claim 5 wherein the vertical spacing between the rails is approximately 4.06 mm and the horizontal spacing between an outer beam and the center beam is approximately 6.6 mm.

* * * * *